US006321724B1

(12) United States Patent
Winsor

(10) Patent No.: US 6,321,724 B1
(45) Date of Patent: Nov. 27, 2001

(54) ENGINE WITH INTEGRATED UNIT PUMP INJECTOR AND METHOD OF MAKING THE SAME

(75) Inventor: Richard Edward Winsor, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/563,691

(22) Filed: May 3, 2000

(51) Int. Cl.[7] ..... F02M 37/04
(52) U.S. Cl. ..... 123/509; 123/508
(58) Field of Search ..... 123/509, 508, 123/495, 500, 501, 468, 469, 470

(56) References Cited

U.S. PATENT DOCUMENTS 1,991,586 * 2/1935 Vincent ..... 123/509
5,390,642 * 2/1995 Thoma ..... 123/508
5,419,298 * 5/1995 Nolte et al. ..... 123/508
5,692,477 * 12/1997 Berger et al. ..... 123/468
6,026,786 * 2/2000 Groff et al. ..... 123/501

* cited by examiner

*Primary Examiner*—Henry C. Yuen
*Assistant Examiner*—Mahmoud Gimie

(57) ABSTRACT

An integrated unit pump injector that includes a cam follower, unit pump, injection line and injection nozzle is pre-assembled for installation in an engine block and cylinder head. By pre-assembling the integrated unit pump injector, the assembly can be tested for fuel leaks, injection timing and volume of fuel delivered by the pump without first installing the individual devices in an engine. Variation in fuel output, injection timing and fuel volume is reduced while engine assembly time and cost is also reduced. The integrated unit pump injector orients the pump and nozzle on parallel axes and requires that the pump bore in the block and the nozzle bore in the cylinder head also be parallel to enable the injector and pump to be fixed relative to one another prior to installation and both installed simultaneously by movement in the direction parallel to their axes.

9 Claims, 2 Drawing Sheets

ENGINE WITH INTEGRATED UNIT PUMP INJECTOR AND METHOD OF MAKING THE SAME

BACKGROUND OF THE INVENTION

1. Field of the Invention

The present invention relates to a fuel injected engine having unit pumps and injection nozzles that are integrated with one another as a subassembly enabling the integrated unit pump and injection nozzles to be leak tested and calibrated prior to installation of the integrated pump and nozzle on the engine block and cylinder head.

2. Description of the Related Art

Currently, camshaft followers, unit pumps, injection lines and injection nozzles are installed in engines as individual components. Part variability results in significant variation in fuel output. Injection timing is set by measuring the block and selecting shims to adjust the pump mounting. Fuel leaks will occur if the injection line connections are faulty or not tightened properly.

Only after assembly into an engine are these components coupled with one another, thereby enabling leak testing and calibration of the quantity of fuel delivered by the pump and nozzle. If leaks are present, or if the fuel output is not within the desired specification, significant disassembly of the engine is needed to access the pump or nozzle for correction.

SUMMARY OF THE INVENTION

The present invention overcomes the above disadvantages by assembling the cam follower, the unit pump, the injection line and the injection nozzle together as an integrated unit pump injector before installation of any of these components into the engine block and cylinder head. The integrated assembly can be internally shimmed to give the correct injection timing and tested for fuel output and leaks. Any assemblies with leaks or fuel output outside the specified range would be disassembled and corrected. The integrated unit pump injector is then installed in the engine by simultaneously inserting both the injection nozzle and the unit pump into the cylinder head and block respectively. The simultaneous installation of the injection nozzle and pump as an integrated unit necessitates that the injection nozzle bore in the cylinder head and the pump bore in the block be parallel with one another. This is not the case with many engine designs.

By having an pre-assembled integrated unit pump injector, the entire assembly can be installed in the engine without subsequent adjustment or alteration. This reduces the engine assembly time and cost, reduces the engine output variability and reduces the likelihood of leaks. A further advantage is a shorter feedback time to the manufacturer of the pumps and injection nozzles of any manufacturing defects. This is possible by having the pump and nozzle manufacturer test the integrated assembly before shipment to an engine manufacturer rather than waiting until the components are assembled into an engine, the entire engine tested and defects in the pumps or nozzles reported to the pump and nozzle manufacturer.

A unit pump is associated with each cylinder of an engine.

DESCRIPTION OF THE PREFERRED EMBODIMENT

Figure 1:
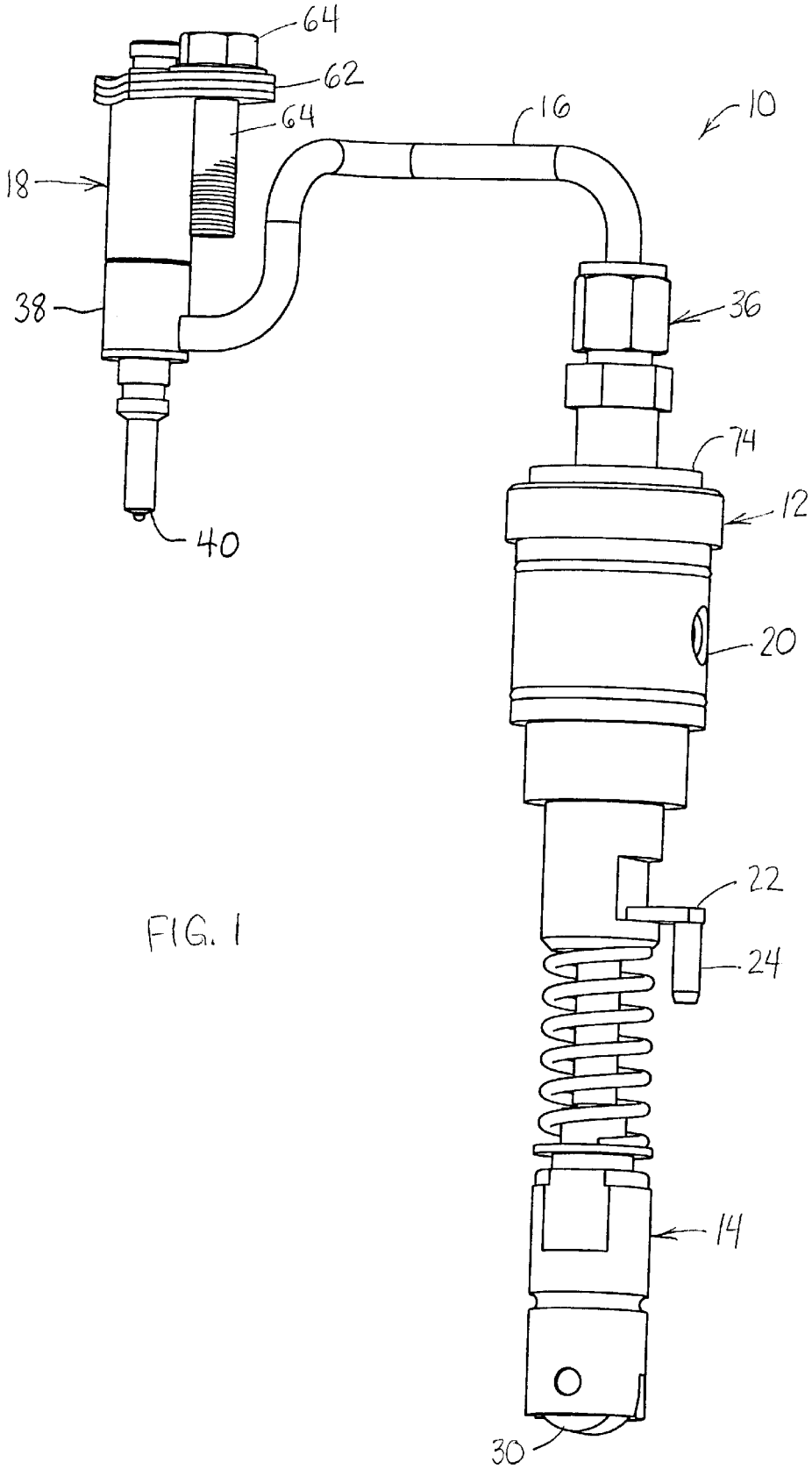
FIG. 1 is a side elevational view of the integrated unit pump injector of the present invention.

The integrated unit pump injector of the present invention is shown in FIG. 1 and designated generally at 10. The integrated unit pump injector includes a unit pump 12, a cam follower 14, an injection line 16 and an injection nozzle 18. The nozzle axis and the pump axis are parallel to each other to enable the integrated unit pump injector to be installed in an engine as described below.

Figure 2:
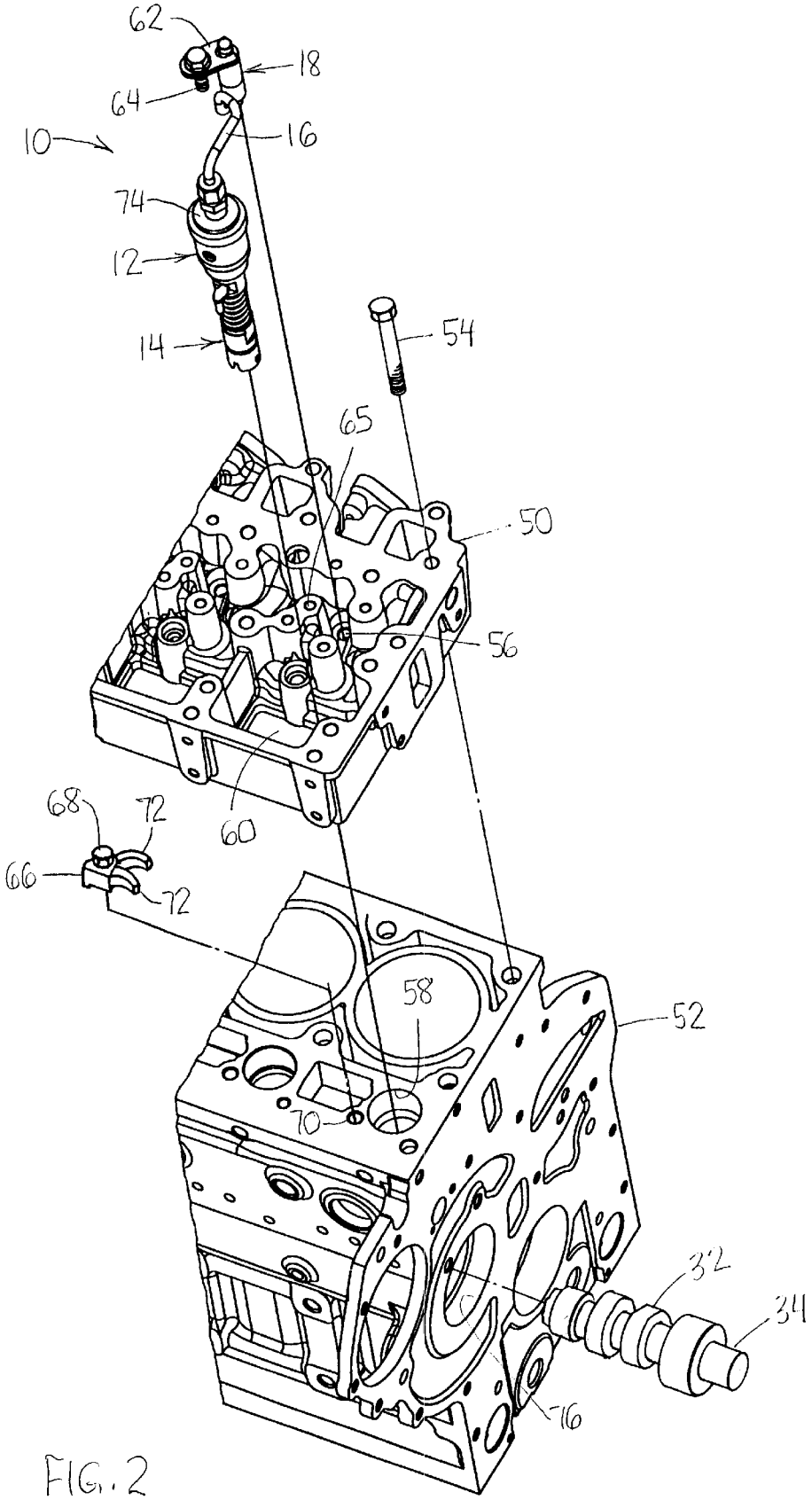
FIG. 2 is an exploded perspective view of the engine block, cylinder head and integrated unit pump injector.

The unit pump 12 is a conventional pump and includes a fuel inlet port 20. The internal plunger of the pump is coupled to a radial control arm 22 which has a pin 24 that couples to a control rod. The control rod is moved by the engine governor to turn the pump plunger to vary the amount of fuel delivered per stroke of the pump plunger. The cam follower 14 includes a roller 30 that engages a lobe 32 on the camshaft 34 shown in FIG. 2. The camshaft lobe causes an upward stroke of the pump plunger.

The pump outlet is coupled to the injection line 16 through a threaded coupling 36. The opposite end of the injection line 16 is integrally joined to the body 38 of the injection nozzle 18. Alternatively, the injection line can be joined to the nozzle through another threaded coupling. The nozzle 18 terminates in a tip 40 that delivers fuel to the combustion chamber.

The integrated unit pump injector 10 is assembled together as shown in FIG. 1 as a subassembly prior to installing the components in the engine block or cylinder head. Once assembled, the integrated unit pump injector is tested for leaks and fuel volume output and is shimmed internally to give correct injection timing. Any assemblies with leaks or fuel output outside the specified range are disassembled and corrected. The integrated unit pump injector 10 is subsequently installed in an engine after the cylinder head 50 is fastened to the engine block 52 by a plurality of bolts 54 in a conventional manner. The cylinder head 50 is provided with a nozzle bore 56 that receives the nozzle 18 of the integrated unit pump injector. Similarly, the block 52 includes a pump bore 58 that receives the pump 12. The pump bore 58 and nozzle bore 56 are parallel to one another.

The integrated unit pump injector 10 is installed in the engine by simultaneously placing the pump 12 into the pump bore 58 and the injection nozzle 18 into the nozzle bore 56. The pump passes through an opening 60 in the cylinder head and into the pump bore 58 of the block.

A fork shaped nozzle hold down member 62 secures the nozzle to the cylinder head. A bolt 64 is inserted into the threaded aperture 65 in the cylinder head. Likewise, a fork shaped pump hold down member 66 is retained by a threaded fastener 68 in the aperture 70 in the block to secure the pump to the block. The pump hold down member 66 engages the horizontal upper surface 74 of the pump 12.

Prior to installation of the unit pump injector, the camshaft 34 is installed in the engine block through the opening 76 at the end of the block. The camshaft is positioned below the pump to be engaged by the cam follower 14. The camshaft has a lobe for the unit pump of each cylinder.

Use of the integrated unit pump injector of the present invention is made possible by orienting the nozzle bore 56 and the pump bore 58 parallel with one another so that the joined pump and nozzle can be inserted simultaneously, as an assembly, into the cylinder head and block. The integrated unit pump injector and method of manufacturing makes it possible to reduce engine assembly time and cost.

Furthermore, the integrated unit pump injector reduces output variability and the likelihood of leaks.

The invention should not be limited to the above-described embodiment, but should be limited solely by the claims that follow.

I claim:

1. A method of manufacturing a fuel injected engine comprising the steps of:

attaching a cylinder head to an engine block, the cylinder head having a nozzle bore for receiving a fuel injection nozzle and the block having a pump bore for receiving a unit pump, the nozzle bore and the pump bore being parallel with each other when the cylinder head is attached to the block; and installing a pre-assembled integrated unit pump injector having an injection nozzle, a unit pump and an injection line connecting the injection nozzle to the unit pump, the injection nozzle and the unit pump each having an axis with said axes being oriented parallel with one another, the integrated unit pump injector being installed in the block and cylinder head by simultaneously inserting the nozzle and the pump into the nozzle and pump bores respectively.

2. The method as defined by claim 1 wherein the integrated unit pump injector includes a cam follower coupled to the unit pump for engagement with a camshaft carried by the block.

3. The method as defined by claim 1 further comprising the steps of:

securing the nozzle to the cylinder head with a first hold down member; and securing the pump to the block with a second hold down member.

4. The method as defined by claim 3 wherein the first and second hold down members are attached by threaded fasteners in bores in the cylinder head and the block parallel to the nozzle and pump bores.

5. A method of manufacturing a fuel injected engine comprising the steps of:

assembling an integrated unit pump injector by coupling a unit pump to an injection nozzle via an injection line with a longitudinal axis of the nozzle parallel with a longitudinal axis of the pump;

attaching a cylinder head to an engine block, the cylinder head having a nozzle bore for receiving a fuel injection nozzle and the block having a pump bore for receiving a unit pump, the nozzle bore and the pump bore being parallel with each other when the cylinder head is attached to the block; and installing the pre-assembled integrated unit pump injector by simultaneously inserting the nozzle and the pump into the nozzle and pump bores in the cylinder head and the block respectively.

6. The method as defined by claim 5 further comprising the step of testing the assembled integrated unit pump injector for leaks prior to installation of the integrated unit pump injector in the cylinder head and the block.

7. The method as defined by claim 5 further comprising the step of calibrating the assembled integrated unit pump injector for the desired fuel volume at a given speed and control arm position prior to installation of the integrated unit pump injector into the cylinder head and the block.

8. The method as defined by claim 5 wherein the integrated unit pump injector includes a cam follower and further comprising the step of installing a camshaft in the block prior to installation of the integrated unit pump injector.

9. The method as defined by claim 5 further comprising the steps of:

securing the nozzle to the cylinder head with a first hold down member; and securing the pump to the block with a second hold down member.

* * * * *